US006454429B1

(12) United States Patent
Liao

(10) Patent No.: US 6,454,429 B1
(45) Date of Patent: Sep. 24, 2002

(54) HAND TOOL HAVING AN ILLUMINATION STRUCTURE

(76) Inventor: Shu-Yuan Liao, No. 8, Industrial Park 19Th. Road, Taichung City (TW)

( * ) Notice: Subject to any disclaimer, the term of this patent is extended or adjusted under 35 U.S.C. 154(b) by 0 days.

(21) Appl. No.: 09/824,895

(22) Filed: Apr. 3, 2001

(51) Int. Cl.[7] ..... B25B 23/18
(52) U.S. Cl. ..... 362/119; 362/253
(58) Field of Search ..... 362/119, 120, 362/253

(56) References Cited

U.S. PATENT DOCUMENTS 5,899,554 A * 5/1999 Hsu ..... 362/119
6,106,133 A * 8/2000 Lee ..... 362/119
6,126,295 A * 10/2000 Hillinger ..... 362/119
6,283,606 B1 * 9/2001 Wei et al. ..... 362/119
6,283,607 B1 * 9/2001 Lin ..... 362/119

* cited by examiner

*Primary Examiner*—Thomas M. Sember
(74) *Attorney, Agent, or Firm*—Connelly Bove Lodge & Hutz

(57) ABSTRACT

A hand tool having an illumination structure includes a metallic handle, and a metallic rotation knob. Thus, the metallic rotation knob can be rotated relative to the metallic handle to move between a first position where the peripheral wall of the rotation knob is in contact with the peripheral wall of the handle, thereby forming an electrical connection state, and a second position where the peripheral wall of the rotation knob is detached from the peripheral wall of the handle, thereby forming an electrical disconnection state.

3 Claims, 3 Drawing Sheets

HAND TOOL HAVING AN ILLUMINATION STRUCTURE

BACKGROUND OF THE INVENTION

1. Field of the Invention

The present invention relates to a hand tool having an illumination structure, and more particularly to hand tool having an illumination structure, wherein the illuminant effect can be easily adjusted by rotation of the metallic rotation knob relative to the metallic handle.

2. Description of the Related Prior Art

The closest prior arts of which the applicant is aware are disclosed in the Taiwanese Patent Publication No. 413124, entitled by "Adjusting Structure of Illuminant Angle of a Socket Wrench", and Taiwanese Patent Publication No. 398376, entitled by "Illumination Device of a Tool". However, in the above-mentioned prior art references, the illumination device has to install a conducting plate, an annular conducting member or connecting member to control the switch of the lighting set, and has to assemble separated housings or clip body additionally to clip the body of the illumination device on the handle of the hand tool, so that the entire conventional illumination device has a complicated construction, thereby increasing the cost of fabrication.

SUMMARY OF THE INVENTION

The present invention has arisen to mitigate and/or obviate the disadvantage of the conventional illumination device of a hand tool.

In accordance with the present invention, there is provided a hand tool having an illumination structure, comprising:

a metallic handle having a hollow cavity defined therethrough, the hollow cavity having a first end having an inner wall formed with an annular inner thread, and a second end having an oblique circular hole defined therethrough;

a metallic rotation knob rotatably mounted on a first end of the metallic handle, an insulation threaded column secured on a base of the metallic rotation knob to rotate therewith, and screwed in the annular inner thread of the hollow cavity;

a metallic spring having a first end secured in the insulation threaded column and rested on the base of the metallic rotation knob, and having a second end extended from the insulation threaded column into the hollow cavity;

at least one battery mounted in the hollow cavity and having a first end urged on the second end of the metallic spring;

a bulb received in the oblique circular hole and having one side rested on a second end of the at least one battery; and a spring member mounted between the bulb and the second end of the at least one battery;

wherein, the metallic rotation knob can be rotated relative to the metallic handle to move between a first position where a peripheral wall of the metallic rotation knob is in contact with a peripheral wall of the first end of the metallic handle, thereby forming an electrical connection state, and a second position where the peripheral wall of the metallic rotation knob is detached from the peripheral wall of the first end of the metallic handle thereby forming an electrical disconnection state.

Preferably, the metallic handle has a second end formed with an arc-shaped recess located at an outlet end of the oblique circular hole.

Preferably, the bulb has a top edge protruding outward from an outlet end of the oblique circular hole.

Preferably, the insulation threaded column has a periphery formed with an annular outer thread.

Further benefits and advantages of the present invention will become apparent after a careful reading of the detailed description with appropriate reference to the accompanying drawings.

DETAILED DESCRIPTION OF THE INVENTION

Figure 1:
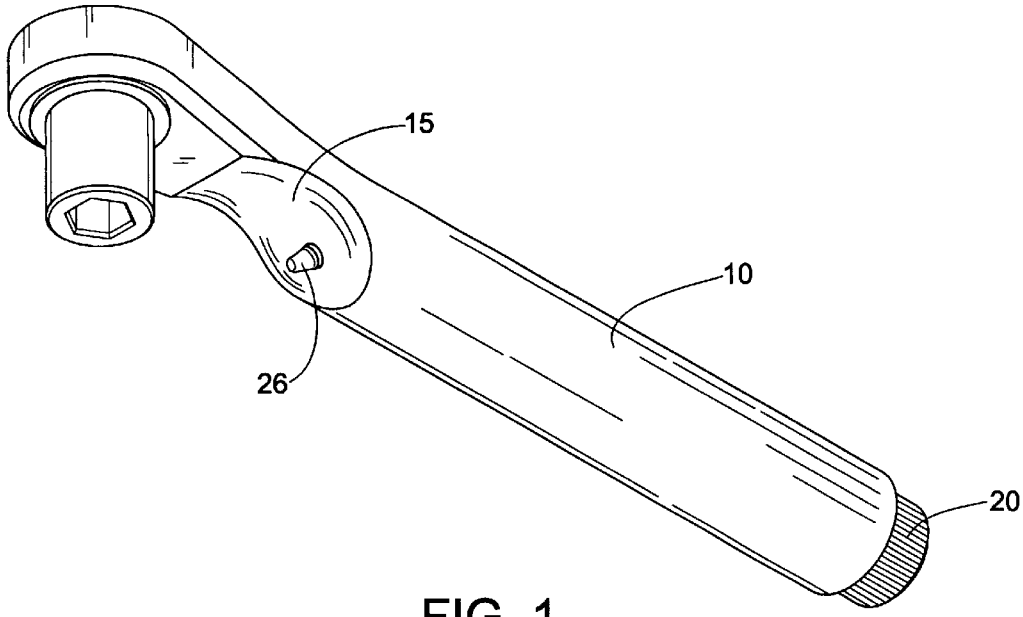
FIG. 1 is a perspective view of a hand tool having an illumination structure in accordance with the present invention.
Figure 2:
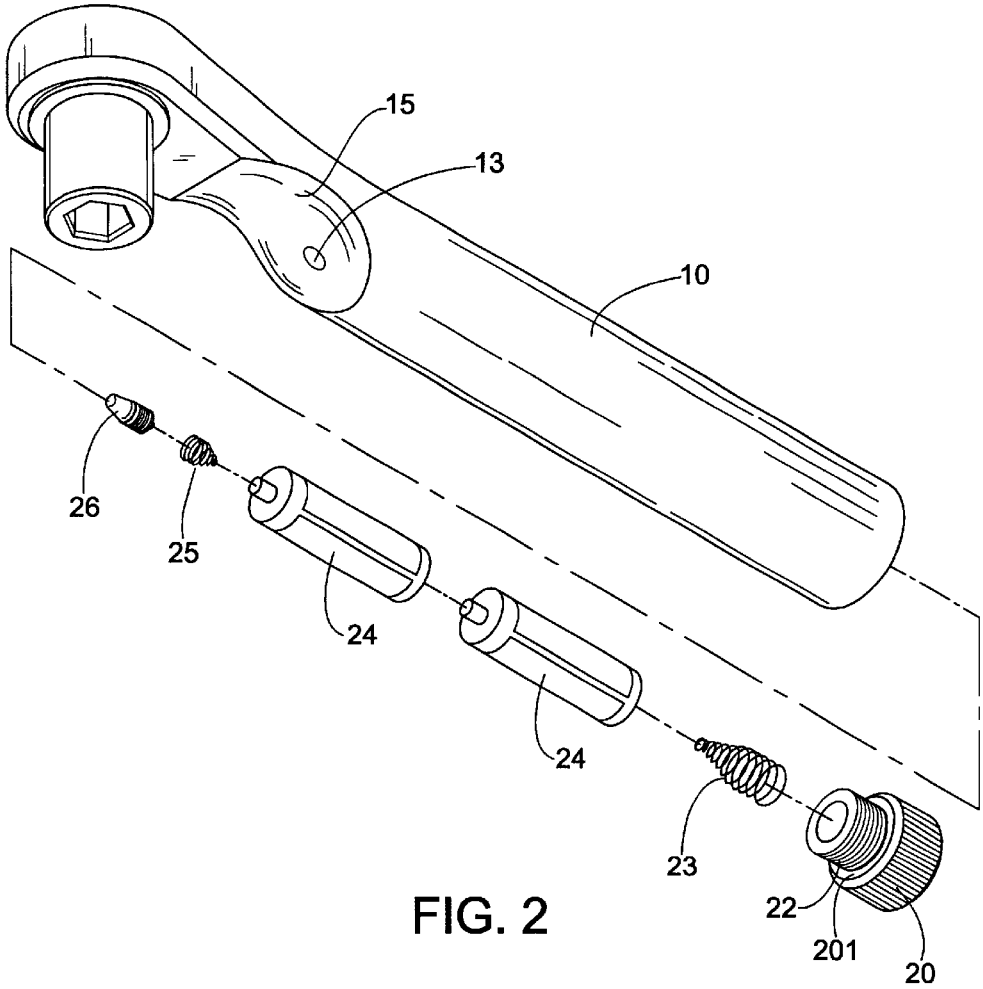
FIG. 2 is an exploded perspective view of the hand tool having an illumination structure as shown in FIG. 1.
Figure 3:
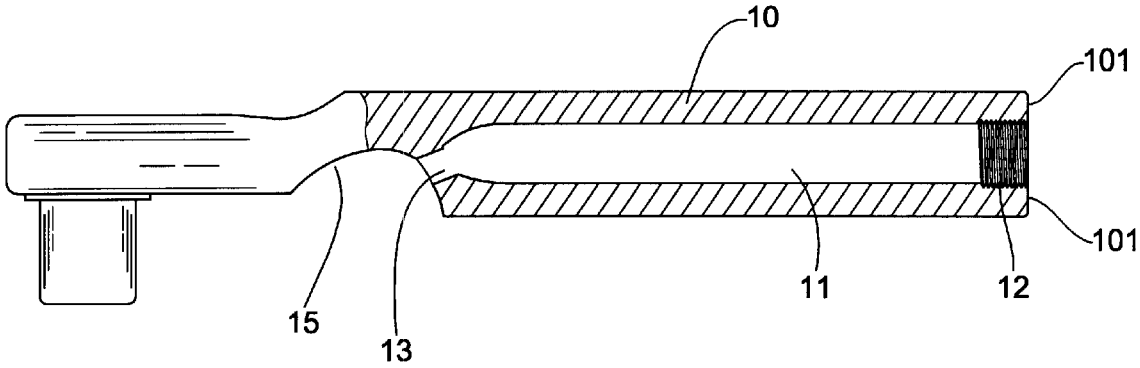
FIG. 3 is a front plan cross-sectional view of a metallic handle of the hand tool having an illumination structure as shown in FIG. 1.
Figure 4:
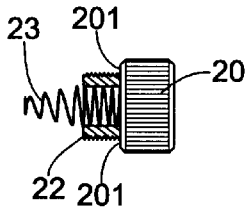
FIG. 4 is a front plan cross-sectional view of a metallic rotation knob of the hand tool having an illumination structure as shown in FIG. 1.

Referring to the drawings and initially to FIGS. 1–5, a hand tool having an illumination structure in accordance with the present invention comprises a metallic handle 10 having a hollow cavity 11 defined therethrough. The hollow cavity 11 has a first end having an inner wall formed with an annular inner thread 12, and a second end having an oblique circular hole 13 defined therethrough. The metallic handle 10 has a second end formed with an arc-shaped recess 15 located at an outlet end of the oblique circular hole 13.

A metallic rotation knob 20 is rotatably mounted on a first end of the metallic handle 10. An insulation threaded column 22 is secured on the base of the metallic rotation knob 20 to rotate therewith, and is rotatably screwed in the inner thread 12 of the hollow cavity 11. The insulation threaded column 22 has a periphery formed with an annular outer thread.

A metallic spring 23 has a first end secured in the insulation threaded column 22 and rested on the base of the metallic rotation knob 20, and has a second end extended from the insulation threaded column 22 into the hollow cavity 11. A battery set 24 is mounted in the hollow cavity 11 and has a first end urged on the second end of the metallic spring 23, for supplying the electrical power of illumination. A bulb 26 is received in the oblique circular hole 13 and has one side rested on a second end of the battery set 24. The bulb 26 has a top edge protruding outward from an outlet end of the oblique circular hole 13. A spring member 25 is mounted between the bulb 26 and the second end of the battery set 24, for locking and positioning the bulb 26 in the oblique circular hole 13.

Figure 5:
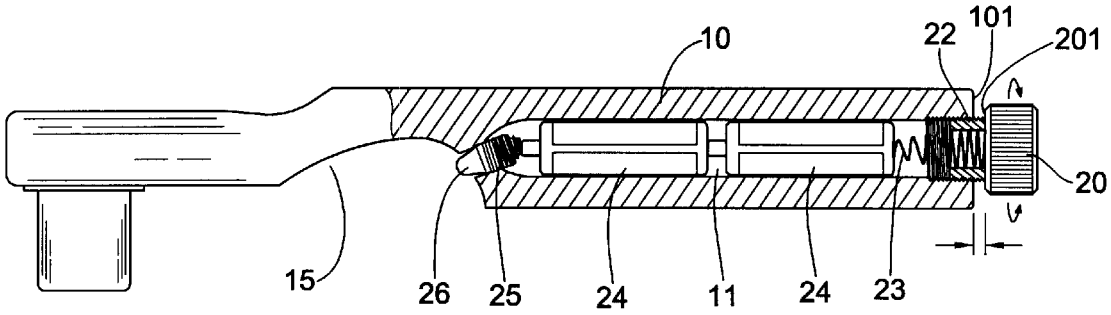
FIG. 5 is a front plan cross-sectional view of the hand tool having an illumination structure as shown in FIG. 1.
Figure 6:
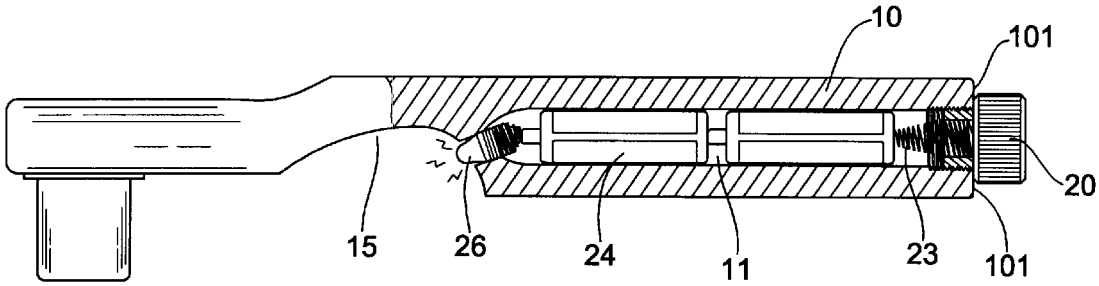
FIG. 6 is an operational view of the hand tool having an illumination structure as shown in FIG. 5 in use.

In operation, referring to FIGS. 5 and 6 with reference to FIGS. 1–4, the hollow cavity 11 of the metallic handle 10 and the wall face of the circular hole 13 are made of metallic material, so that the bulb 26, the metallic spring 25, the battery set 24, the metallic spring 23, and the metallic rotation knob 20 form a metallic conducting structure.

The peripheral wall 201 of the metallic rotation knob 20 is initially detached from the peripheral wall 101 of the first end of the metallic handle 10 as shown in FIG. 5, thereby forming an electrical disconnection state by the insulation threaded column 22. In such a manner, the bulb 26 is not energized.

Then, the metallic rotation knob 20 can be rotated relative to the metallic handle 10 to move from the position as shown in FIG. 5 to the position as shown in FIG. 6 where the peripheral wall 201 of the metallic rotation knob 20 is in contact with the peripheral wall 101 of the first end of the metallic handle 10, thereby forming an electrical connection circuit, such that the bulb 26 is energized, thereby providing an illumination function.

It is appreciated that the arc-shaped recess 15 defined in the handle 10 can be used to enhance the light concentration effect of the bulb 26.

Accordingly, the hand tool in accordance with the present invention can easily and efficiently adjust the illuminant effect of the bulb 26 by rotation of the metallic rotation knob 20 relative to the metallic handle 10, thereby increasing the usage efficiency of the hand tool. In addition, the metallic knob 26 can be designed to have an elastic metallic press button structure, thereby forming a press conducting state of the metallic conduct. Further, the metallic rotation knob 20 can be easily mounted on and detached from the metallic handle 10, thereby constructing a hand tool having an illumination structure, which is easily assembled and dismantled, has a low price of fabrication, and is easily operated.

Although the specific embodiments of the present invention have been described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claim or claims.

What is claimed is:

1. A hand tool having an illumination structure, comprising:

a metallic handle (10) having a hollow cavity (11) defined therethrough, said hollow cavity (11) having a first end having an inner wall formed with an annular inner thread (12), and a second end having an oblique circular hole (13) defined therethrough;

a metallic rotation knob (20) rotatably mounted on a first end of said metallic handle (10), an insulation threaded column (22) secured on a base of said metallic rotation knob (20) to rotate therewith, and said insulation threaded column (22) having a periphery formed with an annular outer thread screwed in said annular inner thread (12) of said hollow cavity (11) of said metallic handle (10);

a metallic spring (23) having a first end secured in said insulation threaded column (22) and rested on said base of said metallic rotation knob (20), and having a second end extended from said insulation threaded column (22) into said hollow cavity (11);

at least one battery (24) mounted in said hollow cavity (11) and having a first end urged on said second end of said metallic spring (23);

a bulb (26) received in said oblique circular hole (13) and having one side rested on a second end of said at least one battery (24); and a spring member (25) mounted between said bulb (26) and said second end of said at least one battery (24);

wherein, said metallic rotation knob (20) can be rotated relative to said metallic handle (10) so that said insulation threaded column (22) is screwed and moved in said annular inner thread (12) of said hollow cavity (11) of said metallic handle (10) to move between a first position where a peripheral wall (201) of said metallic rotation knob (20) is in contact with a peripheral wall (101) of said first end of said metallic handle (10), thereby forming an electrical connection state, and a second position where said peripheral wall (201) of said metallic rotation knob (20) is detached from said peripheral wall (101) of said first end of said metallic handle (10) thereby forming an electrical disconnection state.

2. The hand tool having an illumination structure in accordance with claim 1, wherein said metallic handle (10) has a second end formed with an arc-shaped recess (15) located at an outlet end of said oblique circular hole (13).

3. The hand tool having an illumination structure in accordance with claim 1, wherein said bulb (26) has a top edge protruding outward from an outlet end of said oblique circular hole (13).

* * * * *